US006508331B1

(12) United States Patent
Stuart

(10) Patent No.: US 6,508,331 B1
(45) Date of Patent: Jan. 21, 2003

(54) VARIABLE RESONATOR

(75) Inventor: Philip Edward Arthur Stuart, Chatham (CA)

(73) Assignee: Siemens Canada Limited, Tilbury (CA)

( * ) Notice: Subject to any disclaimer, the term of this patent is extended or adjusted under 35 U.S.C. 154(b) by 0 days.

(21) Appl. No.: 09/662,961

(22) Filed: Sep. 15, 2000

Related U.S. Application Data

(60) Provisional application No. 60/154,427, filed on Sep. 16, 1999.

(51) Int. Cl.[7] ..... F01N 1/02

(52) U.S. Cl. ..... 181/250; 181/277; 60/312; 123/184.57

(58) Field of Search ..... 181/227, 228, 181/229, 230, 224, 250, 252, 255, 256, 266, 270, 272, 273, 276, 277, 278, 282; 123/184.57, 399; 60/312

(56) References Cited

U.S. PATENT DOCUMENTS

| | | | | | |
|---|---|---|---|---|---|
| 2,297,046 | A | * | 9/1942 | Bourne | 181/250 |
| 3,194,341 | A | * | 7/1965 | Haag | 181/250 |
| 3,655,011 | A | * | 4/1972 | Willett | 181/227 |
| 4,244,442 | A | * | 1/1981 | Scarton et al. | 181/230 |
| 4,539,947 | A | * | 9/1985 | Sawada et al. | 123/184.57 |
| 4,546,733 | A | * | 10/1985 | Fukami et al. | 123/184.57 |
| 4,874,062 | A | | 10/1989 | Yanagida et al. | |
| 5,014,816 | A | * | 5/1991 | Dear et al. | 181/229 |
| 5,283,398 | A | | 2/1994 | Kotera et al. | |
| 5,317,112 | A | * | 5/1994 | Lee | 181/250 |
| 5,349,141 | A | * | 9/1994 | Horibe et al. | 181/250 |
| 5,502,283 | A | * | 3/1996 | Ukai et al. | 181/228 |

FOREIGN PATENT DOCUMENTS

| | | |
|---|---|---|
| DE | 4305333 | 7/1994 |
| EP | 04262013 | 9/1992 |

OTHER PUBLICATIONS

European Search Report, Sep. 24, 2001.

* cited by examiner

*Primary Examiner*—Khanh Dang

(57) ABSTRACT

A resonator provided for air system that includes a body defining a passageway. A wall is disposed within the chamber and the wall and the chamber are movable relative to one another to define a length and a volume of the cavity. The length and the volume of the cavity define a noise attenuating frequency. By moving the wall and chamber relative to one another the noise attenuating frequency may be changed as the frequency changes during the engine operation. The drive mechanism moves the wall in the chamber relative to one another to change the noise attenuating frequency. The chamber may be a branched type resonator or an inline type resonator. Accordingly, the above described invention provides a resonator that may be adjusted during engine operation to attenuate noise over a variety frequencies.

14 Claims, 4 Drawing Sheets

VARIABLE RESONATOR

RELATED APPLICATIONS

This application claims priority to provisional application No. 60/154,427 filed on Sep. 16, 1999.

BACKGROUND OF THE INVENTION

This invention relates to a resonator primarily for air induction systems or exhaust systems, and more particularly, the invention relates to a quarter wave tube having a variable length and volume.

Internal combustion engines produce undesirable induction noise which adversely affects the output torque and volumetric efficiency of the engine. The induction noise produced by the engine depends on the particular engine configuration and is affected by such factors as the number of cylinders, the volume and shape of the intake manifold plenum and intake runners, and other induction system parameters. The induction noise is caused by a pressure wave that travels from the combustion chamber towards the inlet of the air induction system. The induction noise may be reduced by producing a wave traveling in the direction of the combustion chamber 180 degrees out of phase of the noise wave. To this end, noise attenuation devices such as quarter wave tubes have been developed.

A prior art quarter wave tube is shown in FIG. 1. The induction system includes a body 10 such as a zip tube which defines a passageway 12. The quarter wave tube 14 is in fluid communication with the passageway 12. A quarter wave tube produces a noise canceling wave of a frequency that is one quarter the length of the quarter wave tube 14. Typically, quarter wave tubes are of a fixed length and therefore are designed for a particular frequency. Air induction noise is typically concentrated about several different engine orders or operating conditions of the engine. Additionally, the noise frequency changes as the engine speed changes. Since space is limited under the hood of the vehicle, quarter wave tubes are only provided for the most undesirable noise frequencies and the other noise frequencies are not attenuated. Therefore, what is needed is a quarter wave tube or a group of quarter wave tubes that can change to accommodate the changing noise frequencies during engine operation so that a greater amount of air induction noise may be attenuated.

SUMMARY OF THE INVENTION AND ADVANTAGES

The present invention provides a resonator for an air system that includes a body defining a passageway. A wall is disposed within the chamber and the wall and the chamber are movable relative to one another to define a length and a volume of the cavity. The length and the volume of the cavity defines a noise attenuating frequency. By moving the wall and chamber relative to one another the noise attenuating frequency may be changed as the noise frequency changes during the engine operation. The drive mechanism moves the wall and the chamber relative to one another to change the noise attenuating frequency. The chamber may be a branched-type resonator or an inline-type resonator. Accordingly, the above described invention provides a resonator that may be adjusted during engine operation to attenuate noise over a variety frequencies.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
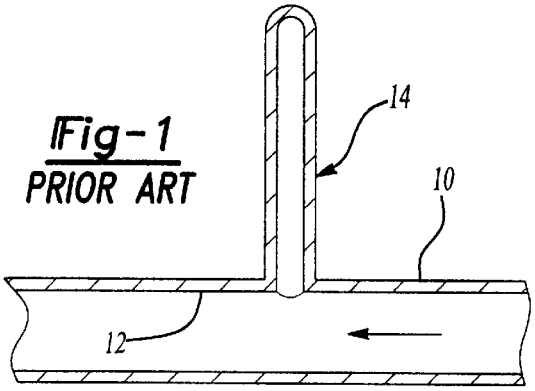
Fig-1 PRIOR ART
FIG. 1 is a cross-sectional view of a quarter wave of the prior art.
Figure 2A:
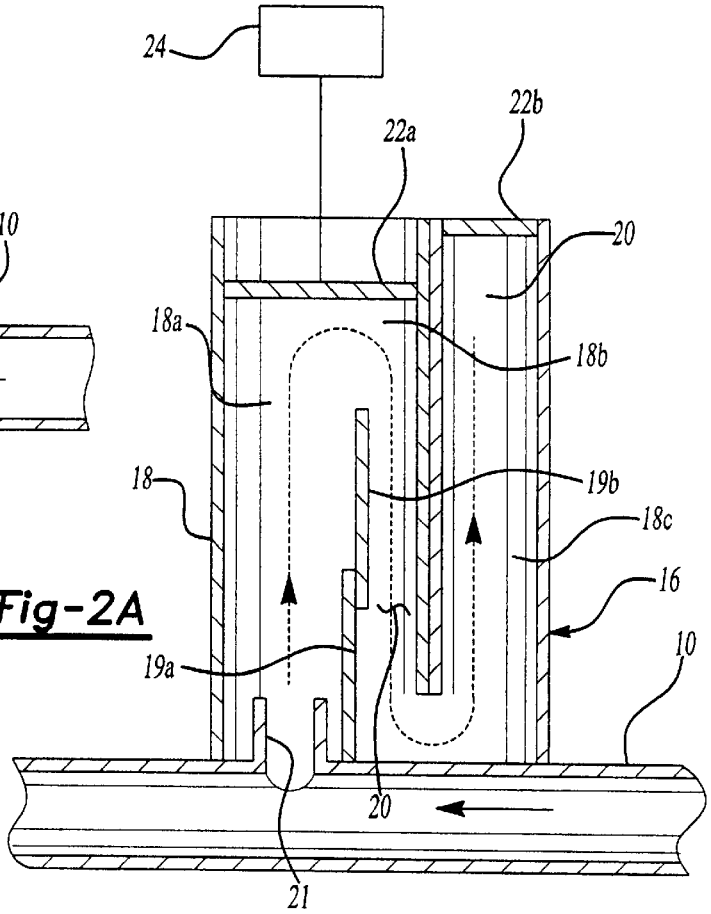
FIG. 2A is a cross-sectional view of one embodiment of the present invention.
Figure 2B:
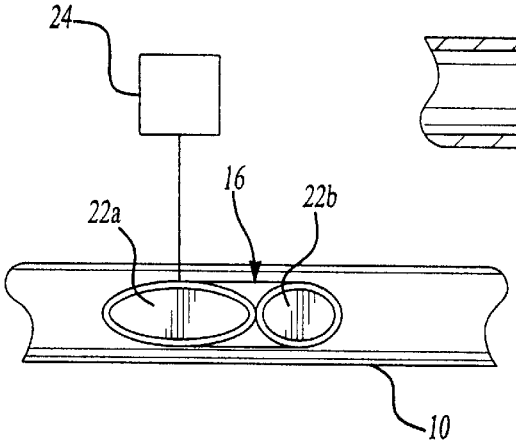
FIG. 2B is a top elevational view of the invention shown in FIG. 2A.
Figure 2C:
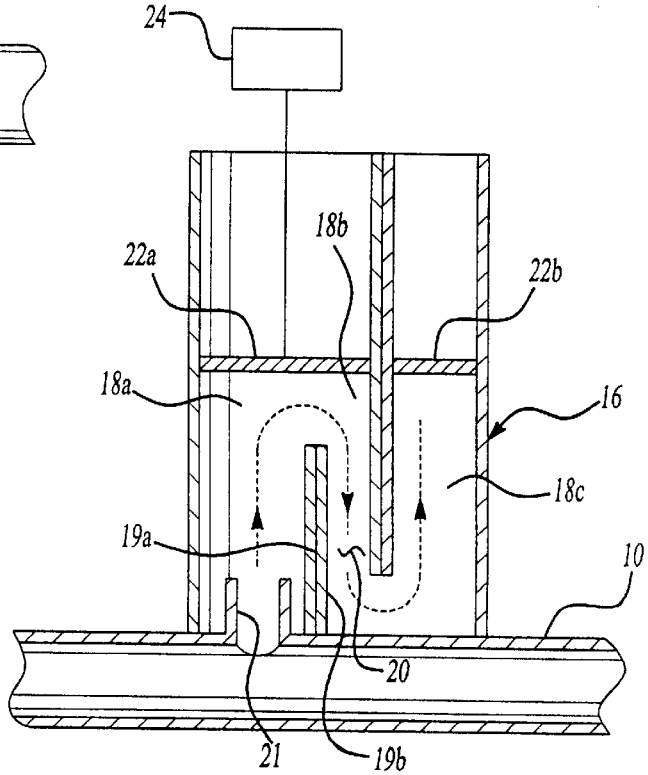
FIG. 2C is a cross-sectional view of the present invention shown in FIG. 2A with a shortened quarter wave tube.

A branch-type resonator 14 is shown in FIGS. 2A–2C. A body 10 defines a passageway 12 that is in fluid communication with the quarter wave tuner 16. The tuner 16 includes a chamber 18, which is preferably constructed from plastic, that forms a cavity 20. To reduce the space required by the tuner 16 the chamber 18 may include a plurality of portions 18*a*, 18*b*, 18*c* that double back on one another to provide a long tuner in a relatively small space. The longer the tuner the lower the frequency of noise attenuated. Longer tuners are used for attenuating lower engine order frequencies and shorter tuners are used for attenuating higher engine order frequencies. Referring to FIGS. 2A and 2B, the tuner 16 includes movable walls 22*a*, 22*b* that move within the chamber 18 to shorten or lengthen the length and volume of the tuner 16. The walls 22*a*, 22*b* may move together or independently from one another. The walls 22 are moved by a drive mechanism 24 that may be an electric servo motor, air or hydraulic actuator, mechanical link, or any other suitable drive mechanism. The portions 18*a* and 18*b* may be separated by separators 19*a* and 18*b* that are movable relative to on another. The separator 19*a* may be fixed relative to the chamber 18 while the separator 18*b* may be movable with the wall 22*a* so that when the wall 22*a* moves the separator 19*b* will move with it. The configuration shown in FIG. 2A represents the maximum length of the tuner and the lowest noise frequency that may be attenuated for the chamber shown. The tuner 16, as shown in FIG. 2C, represents the shortest length and highest noise frequency that may be attenuated for the chamber shown. The walls 22*a* and 22*b* are moved by the drive mechanism 24 toward the body 10 to shorten the overall length of the tuner 16. As a result, the tuner 16 may be adjusted to attenuate the noise of different frequencies.

Figure 3A:
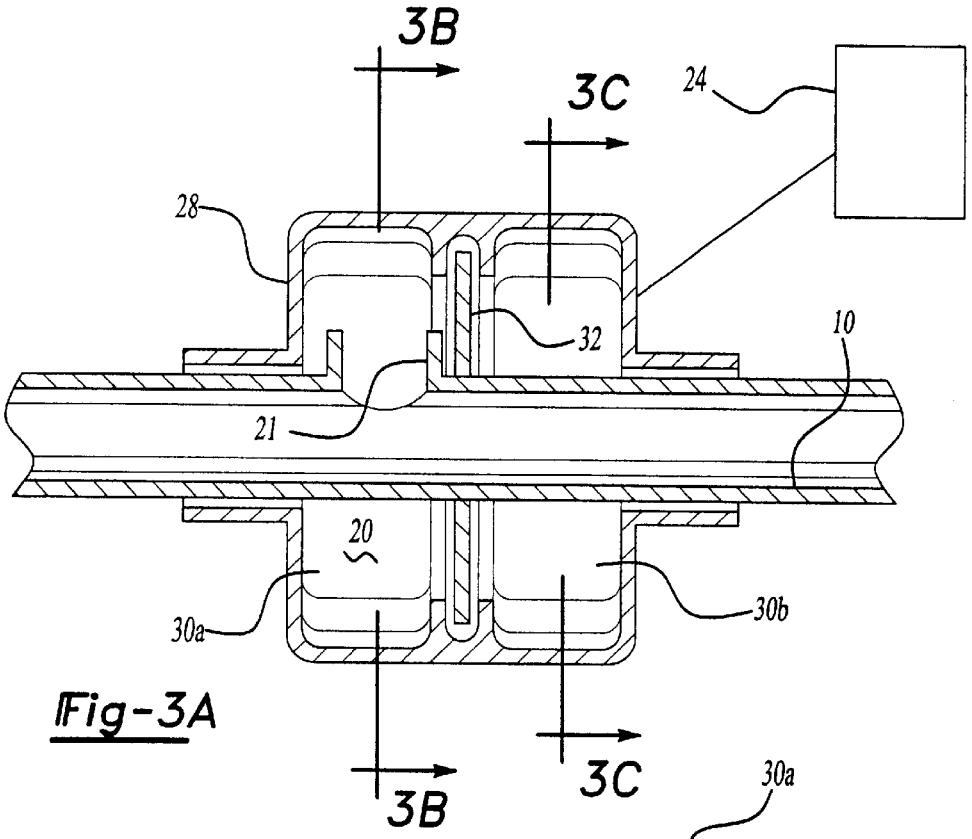
FIG. 3A is a cross-sectional view of another embodiment of the present invention.
Figure 3B:
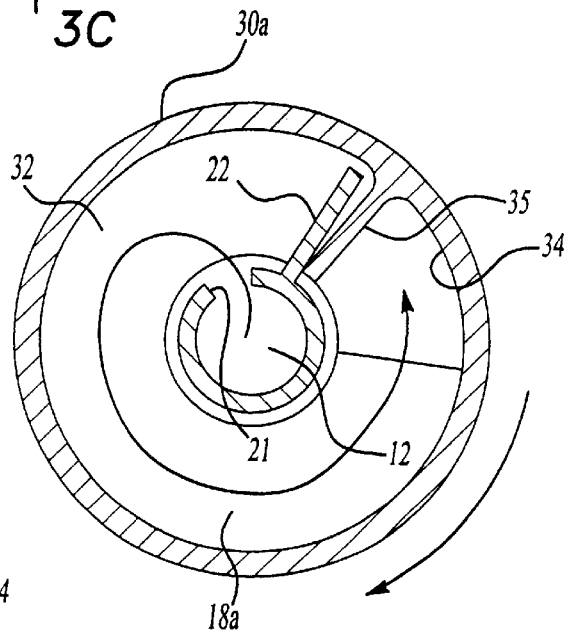
FIG. 3B is a cross-sectional view of the resonator shown in FIG. 3A taken along line 3B—3B.
Figure 3C:
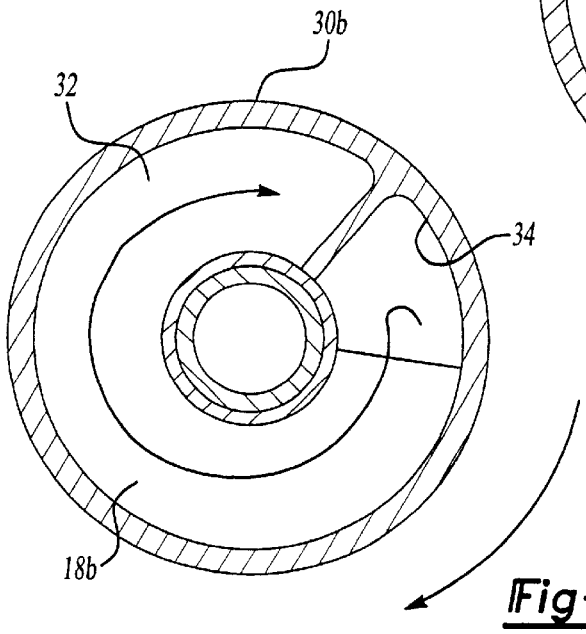
FIG. 3C is a cross-sectional view of the resonator shown in FIG. 3A taken along line 3C—3C.

An inline-type resonator is shown in FIGS. 3A–3C. The chamber 18 is in the shape of a barrel 28 and includes circular turns 30. The turns 30 are separated by walls 32 and are fluidly connected by an opening 34. In this manner, the tuner 16 may be wrapped around the body 10 to provide a long tuner in a relatively small space. The barrels 28 may be injection molded in two halves and then welded about the body 10, or they may be formed in another suitable manner. Referring to FIG. 3B, the air travels from the passageway 12 of the body 10 through an outlet 21 and into the cavity portion 18*a* of a first turn 30*a*. The air flow is directed through the portion 18*a* by a wall 22. The air flow travels through the portion 18*a* and is directed through an opening 34 by a divider 35. The air flow then enters a second turn 30*b* and into a portion 18*b* where the air flow reflects back a noise attenuating wave into the body 10. The length of this barrel shaped tuner may be adjusted by rotating the barrel 28 about the body 10 with the drive mechanism 24. As a result, the divider 35 moves away from the wall 22 thereby shortening the length of the portion 18*a* and the overall length in the tuner 16.

Figure 4A:
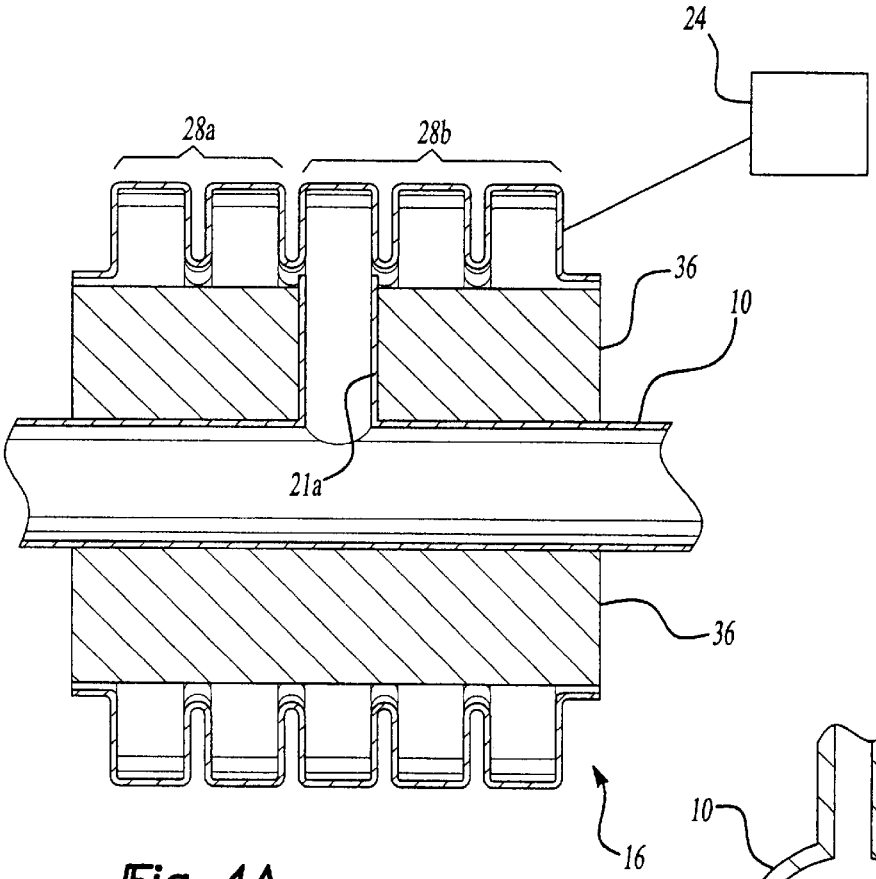
FIG. 4A is a cross-sectional view of another embodiment of the present invention.
Figure 4B:
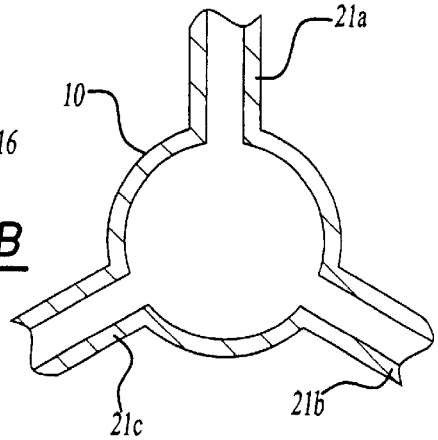
FIG. 4B is an end view of the body shown in FIG. 4A.
Figure 5:
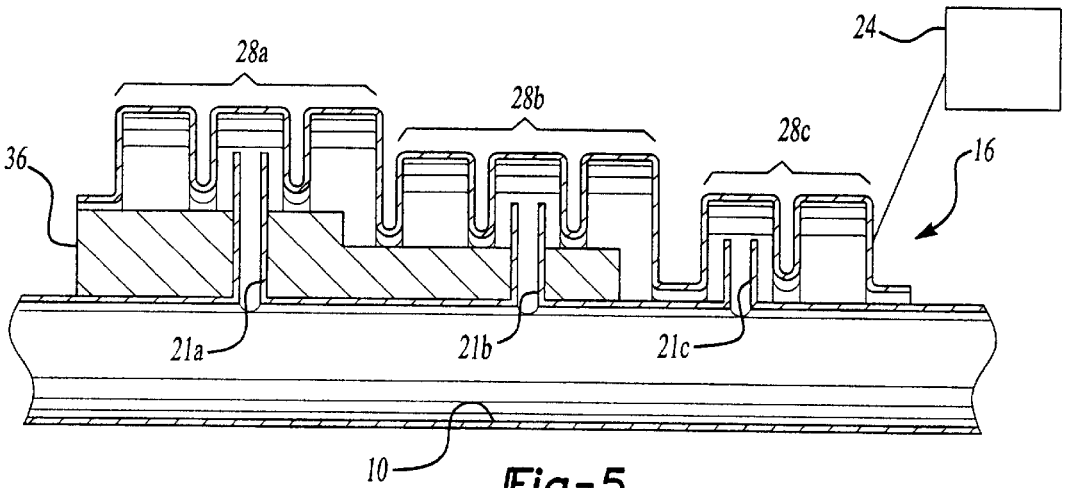
FIG. 5 is a cross-sectional view of another resonator of the present invention for use in attenuating multiple engine order noise frequencies.

The tuner 16 may also include a spacer 36 to space the turns of the barrel 28 away from the body 10 to lengthen the tuner and reduced the number of turns 30 required about the body 10. The body 10 may include any number of outlets 21 that are directed to separate chambers 18 for attenuating multiple noise frequencies simultaneously. The body 10 may include outlets 21*a*, 21*b*, 21*c*, as shown in FIG. 4B, to attenuate the three noise frequencies at the same time. The spacing of the turns 30 of the barrels 28 from the body 10 may be staggered for each noise frequency to be attenuated as shown in FIG. 5.

Figure 6:
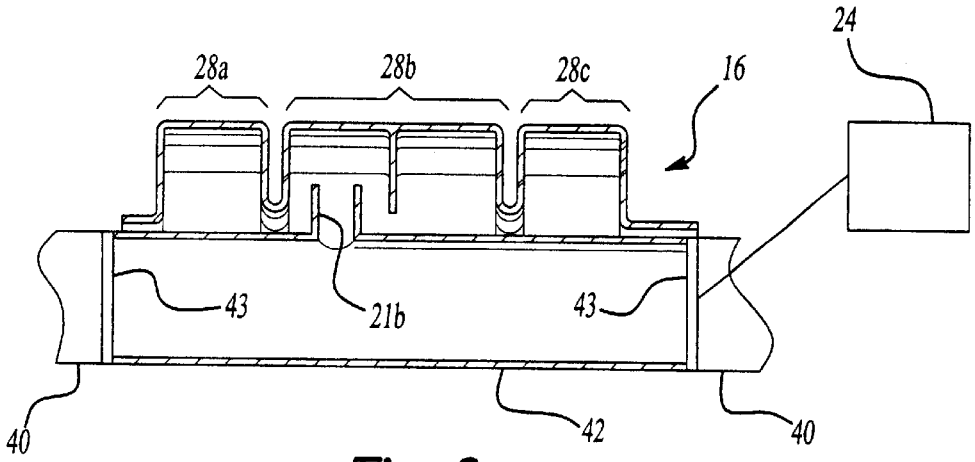
FIG. 6 is an alternative embodiment of the present invention.

It is to be understood that the body 10 may instead be rotated relative to the barrels 28 by the drive mechanism 24, as shown in FIG. 6. Rotating body 42 is disposed within the barrels 28 and is connected to stationary bodies 40 at joints 43. The drive mechanism 24 is connected to the rotating body 42 to drive the rotating body 42 within the barrels 28.

Figure 7:
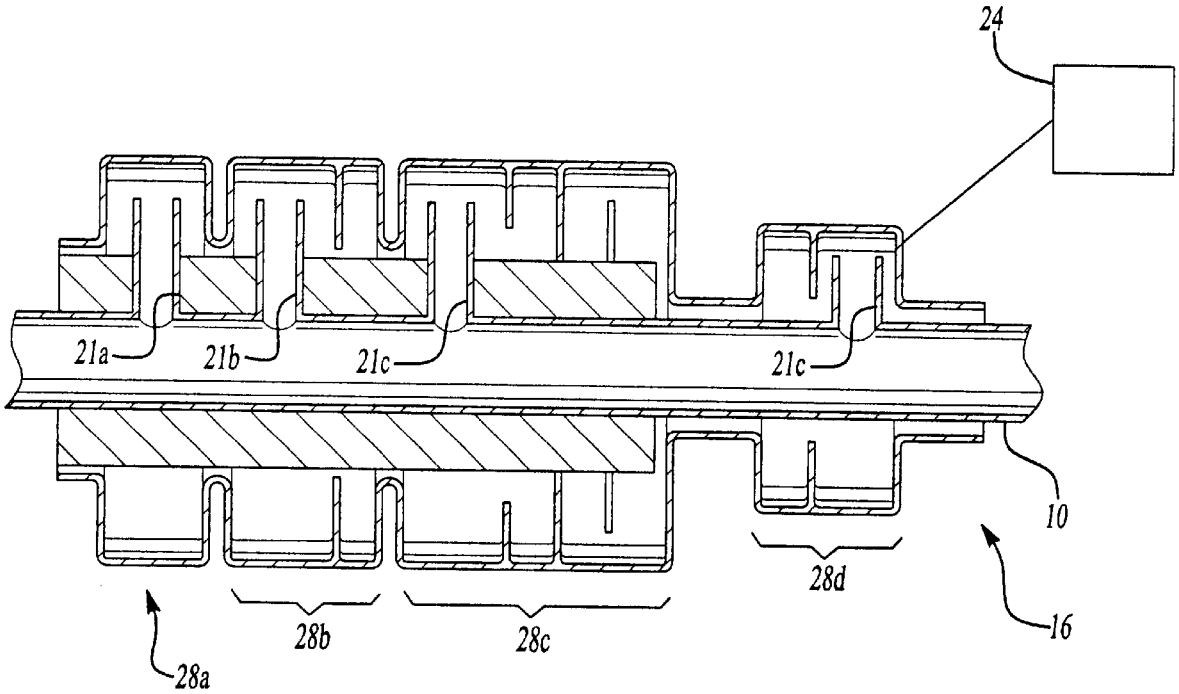
FIG. 7 is a cross-sectional view of the preferred embodiment of the present invention used in attenuating noise for multiple engine orders.

The most preferred embodiment is shown in FIG. 7. The tuner 16 is designed to attenuate noise for a four cylinder, four stroke engine. Primary orders of noise for a four stroke engine occur at a second, fourth, sixth, and eighth order frequencies. The noise frequencies over those orders vary with engine speed and is shown in the following table.

| Engine | frequency of order (Hz) | | | |
|---|---|---|---|---|
| Speed | 2nd | 4th | 6th | 8th |
| 1000 | 33 | 66 | 100 | 133 |
| 6000 | 200 | 400 | 600 | 800 |

Each engine order produces a higher frequency noise. As the engine speed increases the noise frequency increases. Accordingly, it is desirable to have a tuner for each engine order. It is also desirable to have the tuner for each engine order to be of a variable length so that as the engine speed increases the tuner length may be adjusted to attenuate the noise. Through experimentation or calculation the following tuner dimensions may be determined.

| Length of tuner to reduce the frequency (mm) | | | | |
|---|---|---|---|---|
| Engine Speed | 2nd | 4th | 6th | 8th |
| 1000 | 2575 | 1289 | 850 | 639 |
| 6000 | 425 | 212 | 141 | 106 |

To achieve the maximum length, the tuner 16 may be wrapped around the body 10 as needed. As the engine speed increases the tuner length must be decreased so that higher frequency noise may be attenuated. A nominal barrel diameter for each of the tuners may also be determined.

| Nominal barrel diameter for each order (mm) | | | |
|---|---|---|---|
| 2nd | 4th | 6th | 8th |
| 204 | 204 | 135 | 204 |

Barrel 28*a* is the tuner for the $8^{th}$ engine order, barrel 28*b* is the tuner for the $4^{th}$ engine order, barrel 28*c* is the tuner for the $2^{nd}$ engine order, and barrel 28*d* is the tuner for the $6^{th}$ engine order. The barrels 28 are connected to one another so that as the drive mechanism 24 rotates all the barrels 28 relative to the body 10. However, it is to be understood that each barrel 28 may have a separate drive mechanism 24 so that they may be rotated independently of one another.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A resonator for an air system comprising:

a body defining a passageway;

a chamber having a cavity with an interior surface in fluid communication with said passageway;

a slidable wall disposed within said chamber and movable relative thereto to define a length and a volume of said cavity with said wall movable along said length adjacent said interior surface, said length and said volume of said cavity defining a noise attenuating frequency; and a drive mechanism for moving said wall relative to said chamber to change said noise attenuating frequency.

2. The resonator according to claim 1, wherein said chamber extends transversely from said body.

3. The resonator according to claim 2, wherein said wall is an end wall of said chamber that moves along said length relative to said chamber.

4. The resonator according to claim 1, wherein an opening adjoins said body and said chamber to fluidly connect said passageway and said cavity, said wall arranged at an extreme opposite of said opening.

5. The resonator according to claim 4, further including a sound wave entering said opening and hitting said wall with said sound wave reflecting off of said wall back toward said opening.

6. A resonator for an air system comprising:

a body defining a passageway;

a chamber having a cavity in fluid communication with said passageway wherein said chamber wraps about said body to form a plurality of turns;

a wall disposed within said chamber and movable relative thereto to define a length and a volume of said cavity, said length and said volume of said cavity defining a noise attenuating frequency; and a drive mechanism for moving said wall relative to said chamber to change said noise attenuating frequency.

7. The resonator according to claim 6, wherein said turns are connected by an opening.

8. The resonator according to claim 6, wherein said chamber rotates relative to said body.

9. The resonator according to claim 8, wherein said wall extends from said body and a divider extends from said chamber with said divider moving relative to said wall to deprive said length and said volume of said cavity.

10. The resonator according to claim 6, wherein said body rotates relative to said chamber.

11. A method attenuating noise at various frequencies comprising the steps of:

a) sensing an engine;

b) determining a desired resonator cavity length and volume for the engine speed; and c) rotating an air tube and a resonator clamber relative to one another to change the length and the volume of the resonator cavity.

12. A resonator for an air system comprising:

a body defining a passageway;

a plurality of chambers each having a cavity in fluid communication with said passageway;

a wall disposed within each of said chamber with said walls and said chambers movable relative to one another to define a length and a volume for its respective said cavity, said length and said volume of each of said cavities defining a different noise attenuating frequency; and a drive mechanism associated with each chamber for moving said wall and said chamber relative to one another to change said noise attenuating frequency of its respective chamber.

13. A resonator for an air system comprising:

a body defining a passageway;

a chamber having a cavity in fluid communication with said passageway wherein said chamber wraps at least partially about said body;

a wall disposed within said chamber and movable relative thereto to define a length and a volume of said cavity, said length and said volume of said cavity defining a noise attenuating frequency; and a drive mechanism for moving said wall relative to said chamber to change said noise attenuating frequency.

14. The resonator according to claim 13, wherein said chamber wraps about said body to form at least one turn.

* * * * *